United States Patent [19]

Arrant

[11] 4,399,954

[45] Aug. 23, 1983

[54] MANIPULATING LARGE SECTIONS OF ARTIFICIAL TURF

[75] Inventor: Kearney D. Arrant, Florissant, Mo.

[73] Assignee: Monsanto Company, St. Louis, Mo.

[21] Appl. No.: 208,626

[22] Filed: Nov. 20, 1980

[51] Int. Cl.[3] ..... A63C 19/12; B65H 17/46

[52] U.S. Cl. ..... 242/86.52; 254/203; 273/27

[58] Field of Search ..... 242/85, 55, 86.52, 67.1 R, 242/68.7; 254/202, 203; 4/498, 502; 150/52 R; 273/27; 39/156

[56] References Cited

U.S. PATENT DOCUMENTS

| | | | |
|---|---|---|---|
| 1,088,407 | 2/1919 | Derr | 273/27 |
| 3,099,444 | 7/1963 | Burt | 273/27 |
| 3,099,444 | 7/1963 | Burt | 273/27 |
| 3,782,663 | 1/1974 | Stevenson | 242/55 |
| 3,920,136 | 11/1975 | Talbert | 242/55 |
| 3,931,940 | 1/1976 | Raighn | 242/56 R |
| 3,931,940 | 1/1976 | Raighn | 242/66 |
| 4,050,642 | 9/1977 | Katsumata | 242/55 |
| 4,050,972 | 9/1977 | Cardinal | 156/71 |
| 4,074,841 | 2/1978 | Kramer | 226/97 |
| 4,074,841 | 2/1978 | Kramer | 226/97 |
| 4,084,763 | 4/1978 | Zamboni | 242/86.52 |

FOREIGN PATENT DOCUMENTS

| | | | |
|---|---|---|---|
| 1493929 | 7/1967 | France | 273/27 |

OTHER PUBLICATIONS

Turf Roll-Up System (3M Co.) University of Missouri, Columbia, Mo.-Exhibit A.

*Primary Examiner*—John Petrakes
*Assistant Examiner*—Lloyd D. Doigan
*Attorney, Agent, or Firm*—Thomas E. Kelley; Michael J. Murphy; Arthur E. Hoffman

[57] ABSTRACT

A method of removably covering a smooth, rigid surface such as a floor, with a large section of heavy duty, artificial turf which involves pulling it across the surface while supported on a pneumatic cushion to minimize frictional drag and then relieving the cushion after the section is in place to allow it to settle onto the surface. The installation in use comprises such turf supported within its periphery on the pneumatic cushion in contactless overlying relationship above the rigid surface. The apparatus comprises powered rollers for supporting a roll of the turf, rope-like members for attachment to the roll along its leading margin, winches for pulling such rope-like members and a blower for developing the air cushion between the turf and rigid surface.

11 Claims, 2 Drawing Figures

MANIPULATING LARGE SECTIONS OF ARTIFICIAL TURF

BACKGROUND OF THE INVENTION

This invention relates to a method and apparatus for manipulating large sections of artificial turf and the artificial turf installation per se during manipulation, and more specifically to a method and apparatus facilitating repeated covering and uncovering of a rigid surface with such turf.

Artificial turf installations in recent years have become quite widespread for indoor and outdoor uses. In a typical convertible indoor installation such turf has been installed to removably cover a support surface in that it is repeatedly rolled up and stored after each use so the area underneath can be used for other purposes. For example, such a convertible system has been used in manually covering a basketball floor with synthetic turf sold under the trademark Astroturf® of Monsanto Company, where it is used for football practice and then manually rolled up and stored nearby in large rolls to expose the floor for use in playing basketball. Aside from the need for extensive manpower to roll out and roll up the large turf section, the drawback to this approach is the lack of an effective way to shift the large turf area about to remove wrinkles which develop during the roll up and roll out phases. For example, in one such prior art system one end of the turf was anchored to a building wall adjacent the floor being covered and uncovered. During roll up the fabric material in front of the developing roll would stretch so that when fully wound a wrinkle existed between the anchored trailing end and the roll per se. Because of the weight of the large roll, which when wound was on the order of four to five feet in diameter and over one hundred feet in length, the roll could not be conveniently pulled back after roll up to remove the wrinkle nor could it be conveniently removed with the section unrolled because of the large surface area and heavy weight involved. Since such stretching of the thermoplastic material of the turf occurred on the occasion of each rolling up, after an extended period the initial small wrinkle had grown in size to become annoyingly and wastefully large. This resulted in substantial unusable turf in the form of the large wrinkle and an inability to store the roll in the desired, compact, remote storage area adjacent the building wall because of the presence of the space-consuming wrinkle between the anchored end and the roll itself.

Thus a need exists in the prior art for a system to conveniently manipulate large artificial turf sections in a convertible installation involving multiple coverings and uncoverings of a rigid support surface.

SUMMARY OF THE INVENTION

Now improvements have been made to minimize such prior art shortcomings.

Accordingly, it is a principal object of this invention to provide a method and apparatus facilitating the manipulation of large sections of artificial turf during the temporary covering and uncovering of a relatively smooth rigid support surface.

Another object is to provide an improved artificial turf product installation which minimizes frictional drag between the artificial turf and the support surface during the covering and uncovering operations.

Other objects of this invention will in part be obvious and will in part appear from the following description and claims.

These and other objects are accomplished by providing a method of covering a surface with artificial turf which comprises pulling the leading margin of a large section of substantially impervious, heavy duty, artificial turf across a relatively smooth, rigid surface while supporting a substantial portion of it above the surface on a pneumatic cushion, and relieving the cushion after covering the rigid surface to allow such portion to settle thereon. The reverse procedure is used to remove such turf section from the surface.

Also provided from the standpoint of the installation per se is a large section of substantially impervious, heavy duty artificial turf supported within its perimeter in contactless overlying relationship above a rigid surface such as a floor on a pneumatic cushion. During covering and uncovering the cushion is preserved by sealing the section to the floor along its periphery.

From an apparatus standpoint there is provided an apparatus for covering a rigid surface with a large section of substantially impervious, heavy duty, artificial turf comprising powered rollers adapted to support a roll of such artificial turf, a plurality of rope-like members adapted to be secured to the leading margin of the roll, winch means for tensioning such members, and pneumatic means for developing air pressure under the section when over such rigid surface.

BRIEF DESCRIPTION OF THE DRAWING

In describing the overall invention, reference will be made to the accompanying drawing wherein.

DETAILED DESCRIPTION OF PREFERRED EMBODIMENTS

Figures 1, 2:
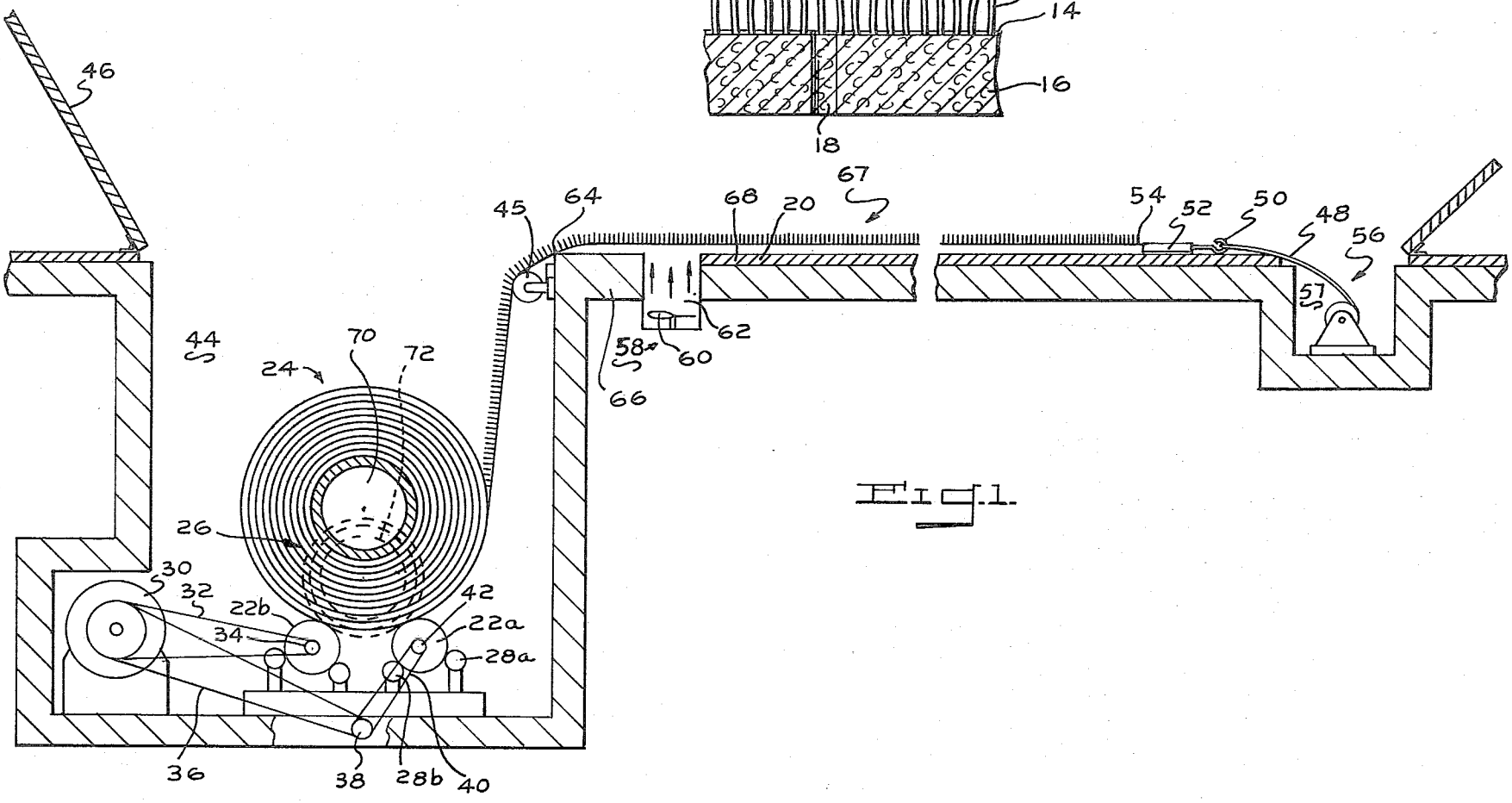
FIG. 1 is a schematic view of an installation embodying the present invention.
FIG. 2 is a cross sectional view in enlarged form of the artificial turf of FIG. 1.

Referring now to the drawing, FIG. 2 shows substantially impervious, heavy duty artificial turf 10 which comprises pile 12 in the form of ribbons of synthetic thermoplastic material such as nylon, polypropylene or the like, knitted, tufted or woven or otherwise secured in a backing 14 to which an underlay in the form of resilient pad 16 comprising a foam structure is laminated, such as by means of a suitable adhesive, or generated by foaming in place. Artificial turf 10 may optionally have narrow vent channels 18 randomly sparingly locally formed in turf 10 through its thickness by piercing with a sharp member such as a pencil-like element, for a purpose to be described. Artificial turf 10 is a heavy duty material capable of repeated wear resistant use weighing between about 0.2 to about 3.5, and typically from about 0.4 to about 1.75 pounds per square foot of surface area. Artificial turf 10 must be substantially impervious in order to hold the air cushion to be described across its expanse during manipulation according to the invention. Depending on the use, however, pad 16 may be dispensed with, certain constructions of turf without pad providing an adequate barrier as to be usable in the invention such as wherein pile 12 is tufted into backing 14. Also, with otherwise pervious forms of turf, pad 16 could be replaced with other members such as a flexible film, sheet, mat or the like to provide the necessary barrier to the air cushion.

Apparatus is shown in FIG. 1 for covering rigid, relatively smooth, horizontal surface 20 in the form of a hardwood floor with a large section 67 of substantially impervious, heavy duty, artificial turf 10. Such apparatus comprises a pair of laterally spaced powered drive rollers 22*a* and 22*b* having a length perpendicular to the plane of FIG. 1 about the same as that of roll 24. Rollers 22*a* and 22*b* are supported for rotation by smaller diameter, journal mounted support wheel pairs 28*a* and 28*b* spaced along rollers 22*a* and 22*b* to reduce bending of the latter. Depending on the weight of turf roll 24, further support roller pairs may be provided. In this regard roll 24 when fully wound is typically on the order of about four feet in diameter and extends lengthwise perpendicular to the plane of FIG. 1 about 30 to 35 feet. Each drive roller 22*a* and 22*b* for this size of roll 24 is in the form of a pipe about eight inches in diameter, and about thirty eight feet long, though the diameter and length of such drive rollers 22*a* and 22*b* may vary from this depending on the size of turf roll 24. The lateral distance between opposite members of each drive roller pair 22*a* and 22*b* is set so that after unwinding turf roll 24 to the desired extent, the final unwound diameter is such that the roll will not fall between a roller pair 22*a*, 22*b*. The unwound roll is shown in phantom at 26 as still resting on roller pair 22*a* and 22*b*. Power means is provided in the form of conventional electric motor 30 operatively connected via optional, associated power transmission means, not shown, and transmission belt 32 to drive roller shaft 34 and cause drive roller 22*b* to turn, while additional transmission belt 36 turns intermediate shaft 38 through which power is transmitted via belt 40 to shaft 42 of drive roller 22*a*.

The powered support rollers and associated drive system just described are preferably located in storage pit 44 adjacent and below floor 20 in order to provide an out-of-the-way storage area for the activation system and roll 24. When liftable, hinged cover 46 is lowered over pit 44 into seated position flush with floor 20 after roll 24 is wound or unwound the roll turning system is temporarily closed off from the surroundings. Obviously alternative storage locations for roll 24 and its turning system may be employed.

A plurality, for example four for a length of roll 24 of 30 to 35 feet, of rope-like members 48 are adapted to be detachably secured via suitable fasteners 50 to a spar in the form of fabric covered wood member 52 fixedly secured to the leading margin 54 of the artificial turf being applied over floor 20. Members 48 are preferably formed of a material such as rope which will not scratch highly polished floor 20 when pulled across it during operation of the system, though such care need not be taken with other less delicate forms of support surfaces.

Winch means 56 are provided for tensioning members 48, preferably in sunken trough 57 on the other side of floor 20 from pit 44. Alternative locations for such winch means may be selected depending on layout preference. In the illustrated embodiment, one hydraulic winch is provided for each rope 48 which is typically capable of exerting on the order of about 600 to about 1000 pounds pull of force thereon, though this will vary depending primarily on the weight of the turf section being moved.

Pneumatic means 58 for developing low pressure air underneath section 67 of artificial turf overlying the surface of floor 20 comprises at least one low pressure air blower schematically illustrated at 60 preferably also situated in a cavity 62 below ground level adjacent to and a few feet inwardly of sealing edge 64 of foundation 66. Cavity 62 may be conventionally provided with a cover grating, not shown. Blower 60 may be located anywhere closeby floor 20 and flexible or permanent air transmission ducts, not shown, used in an alternative arrangement.

Plural apparatus assemblies of the kind just described may be provided as necessary for each roll of artificial turf being manipulated depending primarily on the size of the support surface being covered. Operative interconnection of the various plural assemblies to minimize equipment components in a manner known to those skilled in the art may be possible.

In operation, the method being described is for the purpose of manipulating large artificial turf section 67 with respect to floor 20, for example, in covering and uncovering such floor therewith. Section 67 in the illustrated embodiment is substantially rectangular in plan view when on the surface of floor 20, but it could be any shape, and in total comprises substantially the entire roll 24 of substantially-impervious, heavy duty artificial turf 10. After raising cover 46, ropes 48 are attached to spar 52 at four points in the plane perpendicular to FIG. 1 whereupon each winch 56 operatively secured to the opposite end of each rope 48 is activated to apply a pulling force on a rope 48 to thereby commence upwardly unwinding roll 24 out of pit 44. During such unwinding the turf passes over idler roll 45 and the leading margin 54 is dragged across and covers the initial portion 68 of floor 20. Motor 30 is activated to cause roll 24 comprising the remainder of the artificial turf section to turn which, with the continued application of pulling forces on ropes 48, further advances turf section 67 across floor 20. Rotation of roll 24 occurs through frictional engagement between its periphery and the peripheries of drive rollers 22*a* and 22*b* on which roll 24 rests.

As more floor is covered more stress is required to pull the heavy turf section up over rear sealing edge 64 and across the floor. When the friction between floor 20 and the heavy turf section becomes sufficiently high as to be difficult to pull much further via winch means 56, blower 60 is activated to generate pneumatic pressure between floor 20 and the overlying section of turf to thereby lift such section off floor 20 a finite clearance distance of about four inches or less. The operable pressure of the pneumatic cushion is that necessary to lift the turf, will depend on the weight of the latter, and is usually on the order of about 0.10 to about 0.50 inches of water. In the illustrated raised position of FIG. 1, large section 67 of heavy duty, artificial turf is supported within its periphery on the pneumatic cushion in contactless overlying covering relationship above the surface of rigid floor 20. As the pulling forces on ropes 48 draw the large section further across floor 20, the air floatation of such section eliminates frictional resistance with the floor at any portion so lifted and in general minimizes such frictional resistance overall. In essence the air supported portion of section 67 slides on the pneumatic cushion. During such floating support, however, the margins of section 67 along the four sides of the rectangular configuration are sealed in that the side and leading margins are engaged with the floor surface and the trailing margin with edge 64 in order to preserve the pneumatic cushion. This is accomplished along the trailing end of the advancing turf section via rubbing contact with sealing edge 64 and along the forward end via rubbing contact of spar 52 with floor 20. Such rubbing movement of member 52 across floor 20 in a manner to be described can serve to clean the floor surface of dirt and the like. Sealing along the side margins parallel to the direction of unwinding and perpendicular to such leading and trailing ends may optionally be promoted by making such side margins heavier than the section supported on the air cushion via suitable perimeter weighting means. For example, when the portion to be supported on air typically weighs between about 0.75 to about 1.75 pounds per square foot, the side margin portions comprising the area inward of the edge for about one foot could weigh between about 1½ to about 2 pounds per square foot. Such increased weight can be provided by securing a suitable flexible, planar weight means capable of being wound up with the turf to the undersurface of the turf or by selectively increasing the density of the foam of resilient support pad 16 along such margins over the density inward of such margins. Complete sealing engagement of the margins with the support surface in the sense of no air escape occurring is not necessary, a slight flow being tolerable if the supporting air is replenished via one or more compressors or blowers 60. During covering of floor 20 after development of the floating support position of section 67 the forces exerted on the leading margin 54 should be substantially less than exerted thereon prior to development of such pneumatic cushion.

Pulling in the manner described continues until floor 20 is covered with the section completely or to the extent desired, whereupon blower 60 is deactivated and, over a relatively brief time period, the air forming the cushion between the turf and floor exits through turf vent channels 18. This causes the section to gradually settle by gravity and collapse onto floor 20 whereupon covering section 67 is ready for use, preferably after releasing ropes 48 from the leading margin. The number and cross sectional size of channels 18 represents a balance between facilitating air escape over a relatively short period after covering and excess air loss during manipulation in the covering and uncovering phases. Such functional channels 18 are sufficiently small in opening individually as not to be noticeable except when the turf is closely examined in order not to detract from the pleasing appearance of the turf section. Alternatively, or in conjunction with channels 18, the air pressure can be dissipated merely by manually lifting the sides up from the floor or trampling on the covering section to force the air out through the seals. Because of the reduced friction between the large expanse of floating section 67 and the underlying floor, the position of the large turf section on the floor can be easily manually adjusted while the pneumatic cushion is maintained, and as a matter of fact after the floor has been fully covered with the section but before relieving the pneumatic pressure the entire section should be readily manually adjustable, for example to center or shift it about on the floor as required. Because of the nature of the air support system wrinkles are self-eliminating.

To retract and wind section 67 up into roll 24, the procedure just described is reversed. Blower 60 is again activated and after a short period to develop the air cushion under and lift section 67 within its margins off floor 20 to eliminate friction between floor and turf, drive rollers **22*a* and 22*b* are caused to turn in a clockwise direction to develop roll 24. Attachment of ropes 48 to spar 52 during wind up could promote guiding movement of the section back into a compact roll configuration with parallel edges of the roll layers. As during unrolling, surface friction between drive rollers 22*a* and 22*b* and the turf now causes the section to wind up into a roll of increasing diameter during removal from floor 20 while the pneumatic pressure is maintained. Winding is around floating steel core 70 which is typically about sixteen inches in diameter and to which trailing end 72 of the turf is attached such as in the form of one or two windings of turf when the floor is fully covered. In the early stage of rewinding if the relatively low weight of turf and core 70 is inadequate to develop sufficient friction with rollers 22*a* and 22*b* to allow winding to commence it may be necessary to weight core 70**, at least initially, for example by filling it with water or other weight-providing material. After completing roll-up in the manner described, undesirable wrinkles of the kind existing in the prior art should not be present because of the air supported movement of the turf.

The invention is usable with any rigid support surface which is unyieldable in the sense of resisting any scraping displacement of its surface when the artificial turf section is dragged across it and which is relatively smooth and preferably planar at least adjacent its edges in order to minimize loss of air at the interface with the margins of the turf during application to and removal from such surface. In this sense, the support surface may be indoors or outdoors and be formed of cement, asphalt, wood or similar level material. Indoor installations are preferred to minimize the change in weight of the turf which is usually accentuated in outdoor applications.

The invention is usable with large artificial turf sections of sufficient expanse to avoid significant escape of the cushioning air out through the sealing regions between the surface being covered and the margins of the section when supported on the pneumatic cushion. While realizing that the sealing margins of the section may be adjusted in weight, narrow rolls in the direction of rolling and unrolling are usually undesirable in the invention from both the standpoint of wasteful cushioning air loss and the fact that the section may be sufficiently lightweight to be handleable without need for the system of the invention. Mindful of the foregoing, an entire athletic field of artificial turf, such as a football playing surface, on the one hand down to sections on the order of about thirty to forty feet wide (along the length of the turf roll) of artificial turf weighing between about 0.20 to about 3.5 and preferably from about 0.4 to about 1.75 pounds per square foot can be manipulated according to the invention. In the latter instance the turf would be about 110 feet and at 0.9 pounds per square foot would weigh about 10,900 pounds.

The preceding description is set forth for purposes of illustration only and is not to be taken in a limited sense. Various modifications and alterations will be readily suggested to persons skilled in the art. It is intended, therefore, that the foregoing be considered as examplary only and that the scope of the invention be ascertained from the following claims.

What is claimed is:

1. A method of removably covering a floor with a large section of substantially impervious, heavy duty artificial turf which comprises:

(a) dragging the leading margin from a roll of said artificial turf across an initial portion of a floor via the application of a pulling force at plural locations along said leading margin, wherein said roll is supported on at least one powered support roller;

(b) turning said roll of said artificial turf comprising the remainder of said section in place in an unwinding direction, while continuing the application of said pulling force to further advance the section across the floor, wherein said turning occurs via frictional contact between the periphery of said roll and said at least one powered support roller;

(c) generating pneumatic pressure between the floor and the overlying section of artificial turf to lift the overlying section within its margins off the floor and minimize friction between the floor and the artificial turf, wherein the margins of the artificial turf section over the floor are in sealing contact with the floor;

(d) continuing the application of pulling force until the floor is covered with the section; and then (e) relieving the pneumatic pressure to permit the section where lifted to settle onto the floor.

2. The method of claim 1 which includes the step of manually adjusting the position of the artificial turf on the floor while the pneumatic cushion is maintained.

3. The method of claim 1 wherein said relieving is effected via air escape through vent channels.

4. The method of claim 1 wherein the leading margin is dragged from the roll by winch inch.

5. The method of claim 4 wherein said turning occurs via frictional contact between the periphery of said roll and two powered support rollers.

6. The method of claim 5 wherein a substantial portion of supported support on the cushion weighs between about 0.75 to about 1.25 pounds per square foot.

7. The method of any of claim 1, 2, 3, 4, 5 or 6 wherein the pressure of the pneumatic cushion is between 0.10 to about 0.50 inches of water.

8. The method of removing a large section of substantially impervious, heavy duty artificial turf from a floor which comprises:

(a) generating pneumatic pressure between the floor and an overlying large section of said artificial turf to lift the overlying section within its margins off the floor and eliminate friction between the floor and the artificial turf where lifted, wherein the margins of the artificial turf section over the floor are in sealing contact with the floor; and (b) winding said section up into a roll of increasing diameter while maintaining said pneumatic pressure until the section is removed from the floor, wherein said roll is supported on at least one powered support roller and wherein said winding occurs via frictional contact between the periphery of said roll and said at least one powered support roller.

9. Apparatus for removably covering a rigid surface with a large section of substantially impervious, heavy duty artificial turf comprising:

(a) at least one powered roller adapted to support and drive a roll of such artificial turf;

(b) a plurality of rope-like members adapted to be secured to the leading margin of the roll;

(c) means for tensioning said members to pull said turf off said roll; and (d) means for developing air pressure within the margins of said section wherein said margins are in sealing contact with said surface.

10. The apparatus of claim 9 wherein said means for tensioning comprises winch.

11. The apparatus of claim 9 having two powered support rollers.

* * * * *